US010486949B2

(12) United States Patent
Yao et al.

(10) Patent No.: US 10,486,949 B2
(45) Date of Patent: Nov. 26, 2019

(54) PULLEY BLOCK HAVING A COVERING ELEMENT AND METHOD FOR MOUNTING A COVERING ELEMENT ON A PULLEY BLOCK

(71) Applicant: Konecranes Global Corporation, Hyvinkää (FI)

(72) Inventors: Rui Yao, Shanghai (CN); Franz Schulte, Herdecke (DE); Dingyuan Zhao, Shanghai (CN); Rene Schlieker, Wetter (DE); Thomas Bönker, Unna (DE); Gereon Imbusch, Mettmann (DE); Thomas Kohlenberg, Paderborn (DE); Oliver Moll, Solingen (DE)

(73) Assignee: Konecranes Global Corporation, Hyvinkää (FI)

( * ) Notice: Subject to any disclaimer, the term of this patent is extended or adjusted under 35 U.S.C. 154(b) by 95 days.

(21) Appl. No.: 15/737,519

(22) PCT Filed: Jun. 14, 2016

(86) PCT No.: PCT/EP2016/063616
§ 371 (c)(1),
(2) Date: Dec. 18, 2017

(87) PCT Pub. No.: WO2016/202792
PCT Pub. Date: Dec. 22, 2016

(65) Prior Publication Data

US 2018/0170727 A1 Jun. 21, 2018

(30) Foreign Application Priority Data

Jun. 19, 2015 (DE) ..... 10 2015 109 900

(51) Int. Cl.
*B66D 3/06* (2006.01)

(52) U.S. Cl.
CPC ..... *B66D 3/06* (2013.01)

(58) Field of Classification Search
CPC ..... B66D 3/06; B66D 3/043; B66D 3/046
See application file for complete search history.

(56) References Cited

U.S. PATENT DOCUMENTS 1,379,868 A * 5/1921 Kelsey ..... B66D 3/06 254/403
2,650,403 A * 9/1953 Taylor, Jr. ..... B66C 1/36 24/598.4

(Continued)

FOREIGN PATENT DOCUMENTS

DE 19602931 A1 7/1997
DE 102008059071 B3 4/2010

(Continued)

OTHER PUBLICATIONS

Preliminary Report on Patentability of the International Searching Authority in English from corresponding Patent Cooperation Treaty (PCT) Application No. PCT/EP2016/063616, English translation completed Dec. 19, 2017.

(Continued)

*Primary Examiner* — Emmanuel M Marcelo
(74) *Attorney, Agent, or Firm* — Gardner, Linn, Burkhart & Ondersma LLP

(57) ABSTRACT

A pulley block for tackles has a pulley surrounded by a covering hood having inlet and outlet openings for a load cable, with a covering element inserted into at least one of the openings and retained by a retaining strip reaching behind an edge of the opening. The covering element has an opening for the load cable that is less than the inlet and outlet opening in the covering hood. The covering element is divided into first and second covering parts such that to mount the covering element on the covering hood with the load cable in a reeved state, the first and second covering (Continued)

parts can be inserted into the inlet and outlet opening via the retaining strips of the first and second covering parts, then reach behind the edge of the inlet and outlet opening, and then be joined to form the covering element in a mounted state.

19 Claims, 12 Drawing Sheets

(56) References Cited

U.S. PATENT DOCUMENTS

| | | | | |
|---|---|---|---|---|
| 2,728,552 | A | 12/1955 | Fate, Jr. | |
| 6,386,516 | B1 * | 5/2002 | Lenders | B66D 3/046 254/393 |
| 7,441,749 | B2 * | 10/2008 | Beaudoin | B66D 3/12 254/358 |
| 7,469,882 | B2 * | 12/2008 | Frommelt | B66C 1/34 254/393 |
| 7,766,307 | B2 * | 8/2010 | Urciuoli | B66D 1/7405 254/278 |
| 2003/0227186 | A1 * | 12/2003 | Eiwan | B66D 3/043 294/82.11 |
| 2004/0183061 | A1 * | 9/2004 | Winter | B66D 3/06 254/411 |
| 2006/0079357 | A1 * | 4/2006 | Bowman | B63H 9/10 474/64 |
| 2006/0207829 | A1 * | 9/2006 | Mauthner | A62B 1/14 182/5 |
| 2011/0204306 | A1 * | 8/2011 | Kingery | B66D 3/046 254/391 |
| 2017/0081152 | A1 * | 3/2017 | Kosuga | B66C 1/34 |

FOREIGN PATENT DOCUMENTS

| | | | |
|---|---|---|---|
| DE | 102008059074 | B3 | 4/2010 |
| EP | 1457455 | B1 | 8/2006 |
| JP | H10109893 | A | 4/1998 |

OTHER PUBLICATIONS

International Search Report and Written Opinion of the International Searching Authority from corresponding Patent Cooperation Treaty (PCT) Application No. PCT/EP2016/063616, indicated completed on Sep. 14, 2016.

* cited by examiner

PULLEY BLOCK HAVING A COVERING ELEMENT AND METHOD FOR MOUNTING A COVERING ELEMENT ON A PULLEY BLOCK

The present application claims the priority benefits of International Patent Application No. PCT/EP2016/063616, filed Jun. 14, 2016, and claims benefit of German Application DE 102015109900.4, filed on Jun. 19, 2015, which are incorporated by reference.

BACKGROUND OF THE INVENTION

The invention relates to a pulley block having a covering element and to a method for mounting a covering element on a corresponding pulley block.

European patent EP1 457 455 B1 discloses such a pulley block in the form of a lower block for hoists. The lower block consists substantially of a central connecting element which intrinsically combines the function of an axle for cable pulleys rotatably mounted thereon at both ends and the function of a receiving element for a load hook. The load hook is mounted from below in the connecting element so as to be able to rotate about a vertical axis. The two cable pulleys are mounted coaxially with respect to one another and rotatably on opposite sides of the connecting element. Reeved load cables which run to the hoist are passed over the cable pulleys. The cable pulleys are provided with a covering hoods as accident protection means. The covering hoods are intended to prevent an operator's fingers or hands from being pulled in and jammed between the cable and cable pulley. Corresponding to the outer contour of the cable pulleys, the covering hoods have approximately a circular disk-shaped outer shape and are divided for mounting in the axial direction of the cable pulleys. The longitudinal division extends such that a cover-shaped outer hood part is produced which is placed in position laterally from the outside over the cable pulley until it comes to lie against an inner hood part where it is fastened. The circumferential separating line of the two hood parts extends, as seen in the radial direction of the cable pulleys, approximately in the region of the centre of the cable groove of the cable pulley. The inner hood part is annular and is formed with an outer circumferential edge, against which the outer hood part comes to lie, and is an integral component of the connecting element. Each of the covering hoods is provided with two inlet and outlet openings to ensure that the load cable passed around the cable pulley can enter and then exit the covering hood.

The cable openings have a width which corresponds approximately to the width of the cable groove of the cable pulley and therefore approximately to 3 times the load cable diameter. The length of the cable opening amounts to approximately 90° in relation to the circumference of the cable pulley or covering hood, wherein a separating web remains in the upper region of the covering hood between the two inlet and outlet openings. Assuming that the zero point of the angle specifications is positioned at the top in the centre of the covering hood, the first inlet and outlet opening begins approximately at 15° and runs to 105° and the second inlet and outlet opening extends from 255° to 345°. The inlet and outlet openings have such a large longitudinal extension in the circumferential direction of the cable pulley because the opening angle between the two strands of the load cables can vary between approximately 0° and 30° in dependence upon the configuration of the hoist and the spaced interval between the hoist and the lower block. In a corresponding manner, the run-out point of the load cable moves from the cable pulley in the region of the inlet and outlet openings and in the circumferential direction of the cable pulley. Since the diameter of the cable amounts to only a fraction of the length of the inlet and outlet opening, each of the inlet and outlet openings has a covering element inserted therein which closes the inlet and outlet opening with the exception of an opening for the cable. This opening is only slightly larger than the diameter of the cable. This prevents the possibility of the lower block operator's hand or fingers being pulled by the load cable into the remaining free space of the inlet and outlet opening. This covering element is held in the slot-shaped inlet and outlet opening so as to be displaceable in the circumferential direction of the cable pulley in order to move conjointly in parallel with the displacement of the cable run-out points in the inlet and outlet opening. In this case, on the one hand, the covering element covers the inlet and outlet opening from outside and, on the other hand, engages in a central region of the inlet and outlet opening—as seen in the circumferential direction of the cable pulley and in a central position of the covering element in relation to the inlet and outlet opening—around the edges of the cable opening in a u-shaped manner inwards. The covering element consists substantially of an upper main strip, a narrow web strip and a lower retaining strip which have an H-shaped cross-section with respect to one another. Moreover, the covering element is formed in one piece as a synthetic material injection-moulded part. For the purpose of mounting the covering element, said covering element is to be slid on at one end of the cable and the outer hood part is at least to be loosened in order to widen the slot-shaped inlet and outlet opening for insertion of the lower retaining strip.

DE 10 2008 059 071 B3 discloses a pulley block having a dividable covering element. The covering element is inserted into an inlet and outlet opening of a covering hood of the pulley block below the inlet and outlet opening such that in this case the inserted covering element does not engage through or behind the covering hood from above.

Further pulley blocks are disclosed in DE 10 2008 059 074 B3, DE 196 02 931 A1, U.S. Pat. No. 6,386,516 B1, U.S. Pat. No. 2,650,403 A and U.S. Pat. No. 2,728,552 A.

SUMMARY OF THE INVENTION

The present invention provides an improved and easy-to-maintain pulley block, in particular a lower block, for hoists.

In accordance with an embodiment of the invention, in the case of a pulley block, in particular a lower block for hoists, having at least one cable pulley which is surrounded by a covering hood having inlet and outlet openings for a load cable, wherein a covering element is inserted into at least one of the inlet and outlet openings and is retained in the inlet and outlet opening by means of a retaining strip which engages behind an edge of the inlet and outlet opening, the covering element has an opening for the load cable and the opening in the covering element is smaller than the inlet and outlet opening in the covering hood, ease of maintenance is achieved by virtue of the fact that the covering element is divided at least into a first covering part and a second covering part in such a way that, in order to mount the covering element on the covering hood, while the load cable is in a reeved state, the first covering part and the second covering part can be inserted with their retaining strips into the inlet and outlet opening, then engage behind the edge of the inlet and outlet opening and finally can be joined in order to form the covering element in a mounted installation state. This can avoid the situation in which, for the mounting procedure, the load cable has to be reeved once again and hood parts of the covering hood have to be opened for a widening of the inlet and outlet opening.

The covering element with its relatively small opening successfully prevents the operator's hand or fingers from being pulled by the load cable into the cable opening of the covering hood. Moreover, the covering element advantageously prevents the load cable which runs into and out of the covering hood from rubbing against the edge of the inlet and outlet openings of the covering hood and thus becoming worn. Also, the cable pulley is more effectively protected against the ingress of dust, dirt and moisture.

In an advantageous manner, provision is made that, as seen in the circumferential direction of the cable pulley, a part of the retaining strip for the allocated lateral edge of the inlet and outlet opening is arranged on the first covering part and a further part of the retaining strip for the allocated other lateral edge of the inlet and outlet opening is arranged on the second covering part. As a result, the covering element can be easily fastened to the covering hood in the region of the inlet and outlet opening.

Exchangeability of the covering elements in the event of wear can be simplified by virtue of the fact that the first covering part and the second covering part are releasably connected to one another in the mounted installation state. This releasable connection can be established in particular by means of a screw-connection.

Particularly easy mounting can be achieved by virtue of the fact that the covering element is divided into the first covering part and the second covering part in a plane which is oriented in the radial direction of the cable pulley and extends in the region of the opening of the covering element.

The covering element achieves particularly longstanding durability by virtue of the fact that the inlet and outlet opening is slot-shaped and the covering element is displaceable in the inlet and outlet opening in the circumferential direction of the cable pulley.

The covering element is easily fastened to the covering hood by virtue of the fact that the covering element covers the inlet and outlet opening from the outside and engages inwardly around the edges of the inlet and outlet opening with the retaining strip.

In particularly simple design terms, the covering element comprises a main strip, a web strip and a retaining strip which together have an H-shaped cross-section, and the retaining strip lies with its guide surface against the inner surface of the covering hood in the region of the inlet and outlet opening.

In order to achieve effective guidance via the load cable, provision is made that the covering element is widened at one end in the shape of a triangle to form a guide region which accommodates the opening for the load cable, said opening being formed as a channel.

In order to achieve ease of mounting, it is sufficient if the covering element in the guide region is divided into the first covering part and the second covering part and the retaining strip in the guide region is arranged on the covering element.

In accordance with a further embodiment of the invention, the covering element is easily mounted on the covering hood by virtue of the fact that, in the case of a method for mounting the covering element on the pulley block, the first covering part is introduced with its part of the retaining strip into the inlet and outlet opening along the load cable, then the first covering part is displaced in the axial direction of the cable pulley so that the part of the retaining strip engages behind the allocated edge of the inlet and outlet opening, then the second covering part is introduced with its part of the retaining strip into a part of the inlet and outlet opening not occupied by the first covering part, then the second covering part is displaced in the axial direction of the cable pulley so that the part of the retaining strip engages behind the other opposite and allocated edge of the inlet and outlet opening, the second covering part is displaced in the inlet and outlet opening in the circumferential direction of the cable pulley in the direction of the first covering part so that the parts of the opening for the load cable are combined to form a common opening, then the first covering part and the second covering part are pushed in the axial direction of the cable pulley towards one another and are releasably connected to one another. This can avoid the situation in which, for the mounting procedure, the load cable has to be reeved once again and hood parts have to be opened for widening the inlet and outlet opening.

An exemplified embodiment of the invention is described in greater detail hereinafter and is illustrated in the drawings.

DESCRIPTION OF THE PREFERRED EMBODIMENTS

Figure 1:
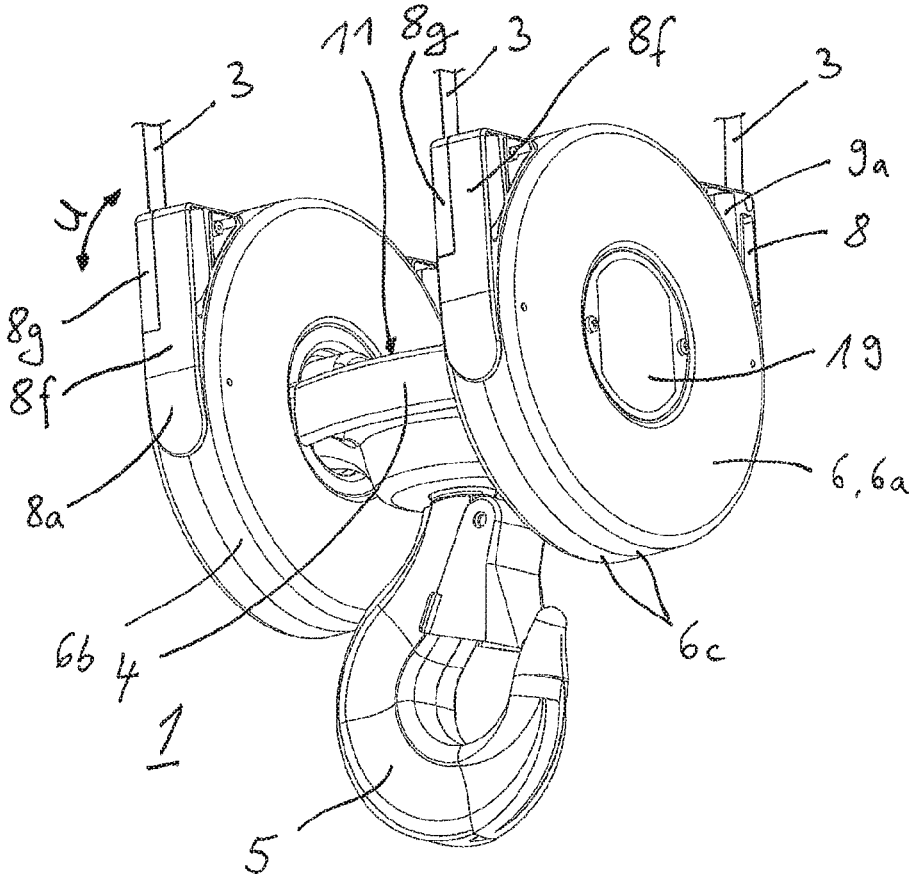
FIG. 1 shows a perspective view of a pulley block in accordance with the invention which is designed as a lower block and has two cable pulleys.
Figure 2:
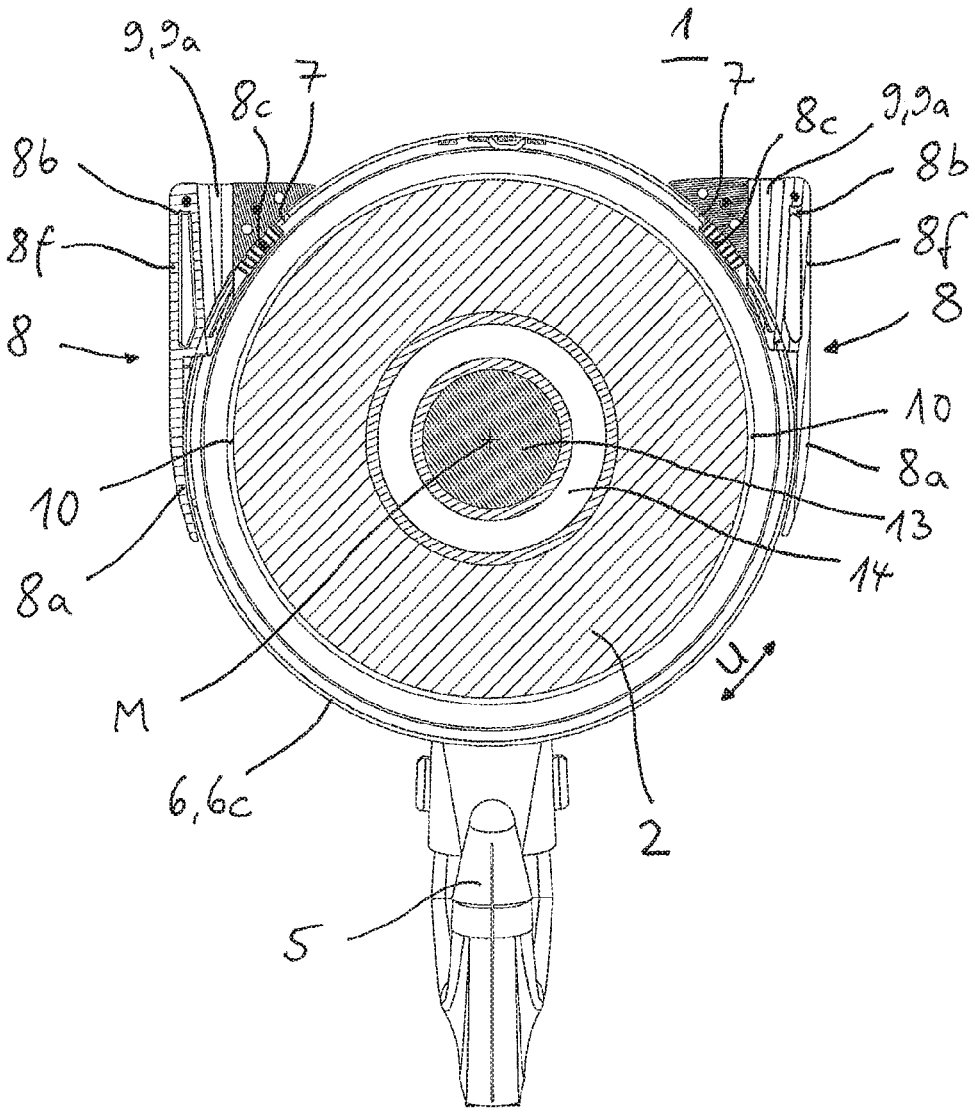
FIG. 2 shows a front view of a lower block shown in FIG. 1 sectioned in the region of a covering hood of a cable pulley with covering elements in a first position.

FIG. 1 shows a perspective view of a pulley block in accordance with the invention which is designed as a lower block 1 and is suspended from a hoist, not illustrated, via two pairs of load cables 3 guided around cable pulleys 2 (see also FIG. 2). FIG. 1 illustrates only three of the strands of the two pairs of load cables 3 exiting or entering the lower block 1 in each case, since a fourth strand is concealed by the lower block 1. The lower block 1 consists substantially of a central connecting element 4 with two cable pulleys 2 mounted laterally thereon and with one load hook 5 suspended therefrom from below. The load hook 5 is mounted in a recess of the connecting element 4 via an axial bearing, not illustrated, so as to be able to rotate about a vertical axis. The cable pulleys 2 which are arranged coaxially with respect to one another and are spaced apart from one another via the connecting element 4 are each surrounded by covering hoods 6 which, as seen in the axial direction of the cable pulley 2, are divided into an outer hood part 6*a* and an inner hood part 6*b* in the plane of the cable pulley 2. The two hood parts 6*a*, 6*b* are identical. The outer hood part 6*a* and the inner hood part 6*b* are each designed as flat ring disks having an externally circumferential and circular arc-shaped edge 6*c*. The outer hood part 6*a* and the inner hood part 6*b* are thus bowl-like or plate-like. In the mounted state, the outer hood part 6*a* lies with its edge 6*c* against the edge 6*c* of the inner hood part 6*b*. The two hood parts 6*a*, 6*b* thus define a flat-cylindrical hollow space for receiving the cable pulley 2. The angularly correct mounting of the two hood parts 6*a*, 6*b* with respect to one another is facilitated by means of a centring sleeve which is inserted into corresponding apertures in the edges 6*c* of the hood parts 6*a*, 6*b*.

Figure 4:
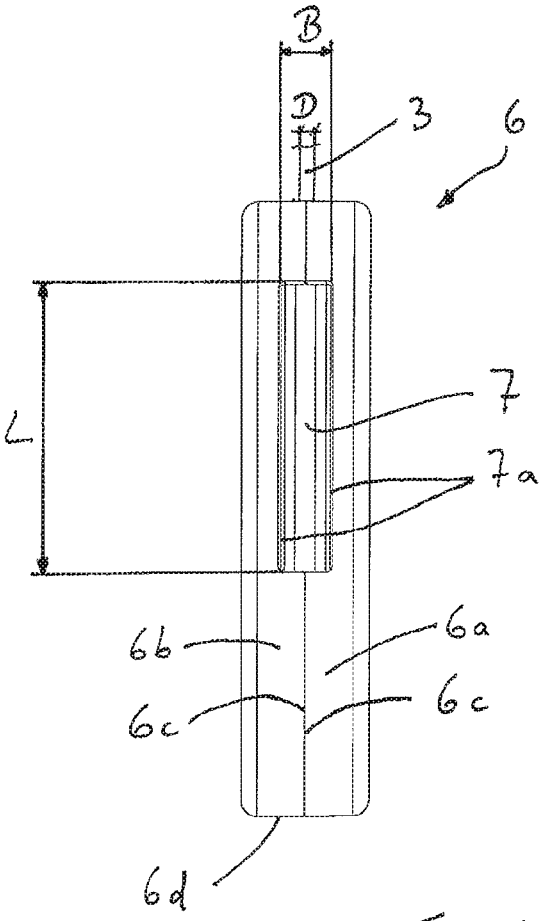
FIG. 4 shows a side view of the covering hood.

Two inlet and outlet openings 7 allowing the load cable 3 to run in onto the cable pulley 2 and allowing it to run out from the cable pulley 2 are each arranged in the covering hoods 6 (see also FIG. 4). As seen in the circumferential direction of the cable pulley 2 or the covering hood 6, these inlet and outlet openings 7 have a length L which corresponds to a multiple of the diameter of the load cable 3 and are thus slot-shaped. The length L corresponds to one sixth of the circumference of the covering hood 6. This length L is required because—as already explained in the introduction of the description relating to the prior art—during operation of the hoist the angle between the strands of the load cables 3 varies and therefore the run-out point 10 (see FIG. 2) of the load cable 3 from the cable pulley 2 changes. The existing length L of the inlet and outlet openings 7 thus prevents the load cable 3 from rubbing past the edges 7*a* of the inlet and outlet openings 7 and thereby being able to cause damage to the covering hoods 6 or the load cables 3.

The thus relatively large inlet and outlet openings 7 are each at least partially closed by a covering element 8 which has an opening 9 for guiding the load cable 3 through from the cable pulley 2 or to the cable pulley 2. In the lowered position of the lower block 1 in which an operator operates the lower block 1, the inlet and outlet openings 7 are each completely closed by the covering element 8. Several meters before the highest raised position of the lower block 1 when the strands of the load cables 3 then spread apart, the covering elements 8 are displaced downwards in the circumferential direction U and each uncover an upper part of the inlet and outlet openings 7. Since an operator does not operate the lower block 1 in the raised position, it is not hazardous in terms of safety to partially uncover the inlet and outlet opening 7.

The opening 9 for the load cable 3 is slightly larger than the diameter of the load cable 3 and has a rectangular cross-section with rounded corners, the width and length of which are in a ratio of 2:1 to 3:1 with respect to the diameter of the load cable 3. This means that the risk of the operator having his fingers or hands pulled by the incoming load cable 3 into the inlet and outlet openings 7 is considerably reduced. In order to take into consideration the previously described fact that during operation of the lower block 1, i.e. during lifting and lowering, the run-out point 10 of the load cable 3 from the cable pulley 2 changes, the covering element 8 can be displaced in the circumferential direction U of the covering hood 6 so as to be able to reciprocate between an upper end position and a lower end position.

The covering element 8 consists substantially of an upper main strip 8*a* which is curved circularly corresponding to the edges 6*c* of the covering hoods 6 and which lies flat on the outer surface 6*d* of the hood parts 6*a*, 6*b* in the region of the edges 6*c* of the hood parts 6*a*, 6*b*. The main strip 8*a* thus covers each of the inlet and outlet openings 7*a*. As seen in the circumferential direction U of the covering hood 6 and beginning from a lower end of the covering element 8, the main strip 8*a* widens slightly from its centre so as to produce a guide region 8*b* for the load cable 3 in the form of a substantially right-angled triangle, the hypotenuse of which, which is curved corresponding to the edge 6*c* of the hood parts 6*a*, 6*b*, is formed by the main strip 8*a*. Outside the guide region 8*b*, the main strip 8*a* is flat and strip-like.

It is also evident in FIG. 1 that the opening 9 for the load cable 3 is formed in the covering element 8 as a channel 9*a* which extends from the main strip 8*a* to an upper one of the two outer leg sides of the guide region 8*b*. The longitudinal extension of the channel 9*a* extends in the plane of the cable pulley 2 at an angle of 90° to a notional straight line extending through the run-out point 10 of the load cable 3 from the cable pulley 2 and the centre point M of the cable pulley 2.

It is also evident in FIG. 1 that, in order to make handling easier for the operator, the lower block 1 has a recessed grip 11, which is open at the top and extends horizontally, in the region of the connecting element 4, the width of which corresponds to the spaced interval between the two covering hoods 6.

It is also indicated in FIG. 1 that the covering element 8 is divided into a first covering part 8*f* and a second covering part 8*g*. This division is effected in the guide region 8*b* of the covering element 8 and is in a plane which is in parallel with the radial direction of the cable pulley 2 and intersects the central point M of the cable pulley 2. This plane is not oriented centrally with respect to the covering element 8 but rather approximately in a ratio of ⅔ to ⅓ of the width of the covering element 8 in relation to the width of the covering element 8. In this case, the first covering part 8*f* has a width of ⅔ of the width of the covering element 8. In a corresponding manner, i.e. by reason of the position of the sectional plane in the centre of the width of the covering element 8, only the first covering part 8*f* is illustrated in cross-section in FIGS. 2 and 3. The division of the covering element 8 renders it possible, in a first mounting step, to introduce the first covering part 8*f* into the inlet and outlet opening 7 and, in a second mounting step, to lock said first covering part at that location by introducing the second covering part 8*g* into the inlet and outlet opening 7. At the end of the mounting procedure, the second covering part 8*g* is releasably fastened to the first covering part 8*f*.

Figure 3:
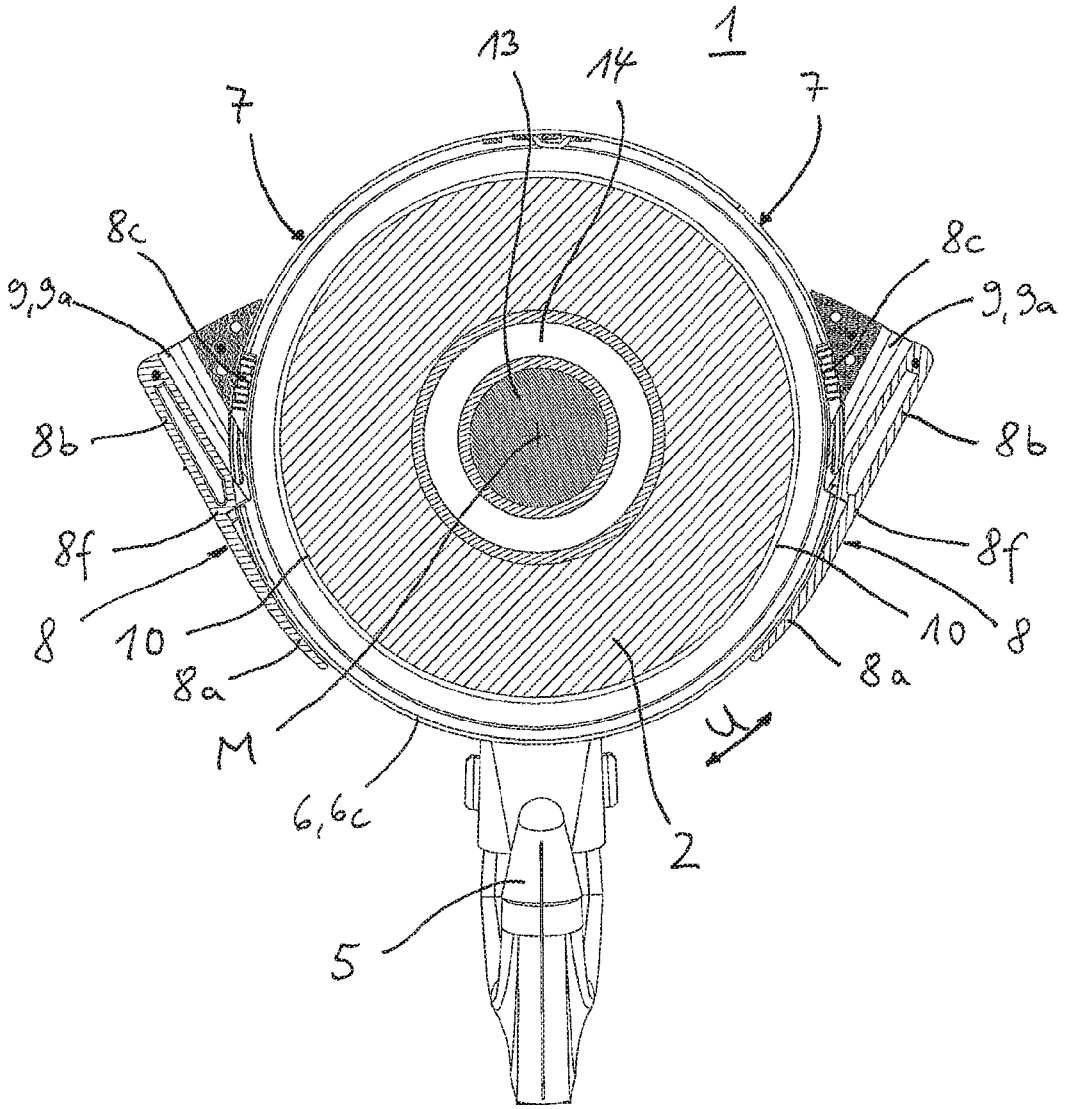
FIG. 3 shows a view shown in FIG. 2 with the covering elements in a second position.

FIGS. 2 and 3 each show a sectional view through one of the two cable pulleys 2 with its adjoining covering hood 6 and the covering elements 8 in two different angular positions of the strands of the load cables 3 with respect to one another and thus two different displacement positions of the covering elements 8 in the cable opening 7. For reasons of clarity, the load cables 3 are not illustrated.

In FIG. 2, the two covering elements 8 are each arranged in a so-called normal position in the inlet and outlet openings 7 in which the lower block 1 is suspended perpendicularly below the hoist and the two strands of the load cable 3 extend almost in parallel with one another. In this normal position, the lower block 1 is suspended in the region of an operator who guides and/or directs the lower block 1 preferably on the grip 11. In this case, the inlet and outlet openings 7 are each completely covered by the cover elements 8. It is evident that the channel 9*a* of the opening 9 extends almost perpendicularly and thus in parallel with the load cables 3. In this case, gravitational force causes the inner wall of the channel 9*a* positioned inwardly with respect to the cable pulley 2 to lie against the side of the load cable 3 facing the opposite load cable 3 because the covering element 8 is guided in a displaceable manner in the circumferential direction of the covering hood 6 with relatively low friction in the inlet and outlet opening 7. The friction occurring between the load cable 3 and the channel 9*a* of the covering element 8 is low because the covering element 8 is very lightweight. Moreover, the covering element 8 is produced as a synthetic material injection-moulded part consisting of a material having a high degree of wear resistance.

FIG. 3 shows the two covering elements 8 in a displacement position which deviates from the normal position illustrated in FIG. 2 and in which the two strands of the load cables 3 form, for instance, an angle of 50° and therefore the two covering elements 8 are located in a lower displacement position. This is the case when the lower block 1 is suspended below the crane trolley in the highest position and therefore cannot be accessed by a user. In the displacement position, an upper part of the inlet and outlet openings 7 is not covered by the covering element 8 because it is not necessary to do so on safety grounds. Essentially, the length of the covering element 8 could be increased accordingly to ensure that, in the normal position and also in the displacement position, the inlet and outlet openings 7 are each completely covered.

FIG. 4 illustrates an individual covering hood 6 without a covering element 6 in an orientation of a lower block 1 suspended perpendicularly from the hoist. The view plane which has been selected is the front or rear side of the lower block 1 and is perpendicular to the axis of rotation of the cable pulley 2 so that one of the inlet and outlet openings 7 can be clearly seen. The inlet and outlet opening 7 is in the form of an elongated rectangle having rounded ends. The width B of the inlet and outlet opening 7 corresponds approximately to 2 to 3 times the diameter D of the load cable 3 and the length of the inlet and outlet openings 7 corresponds approximately to 10 to 15 times the diameter D of the load cable 3 or approximately one sixth of the circumference of the covering hood 6.

FIG. 4 also shows in conjunction with FIG. 2 or 3 that, in relation to the circumferential surface of the covering hood 5 and under the assumption that at the uppermost point of the covering hood 6 the angle is set to 0°, the first inlet and outlet opening 7 begins approximately at 40° and runs to 100°, the second inlet and outlet opening 7 on the opposite side begins in the region of 260° and ends at 320°. The covering element 8 is dimensioned in terms of its length such that in its normal position displaced as far as possible upwards, the lower end of the inlet and outlet openings 7 is still covered. In the displacement position displaced as far as possible downwards, the upper end of the inlet and outlet openings 7 is no longer covered. However, in relation to any possible risks of injury for the operator, this upper region is typically not within the region of access and therefore can remain open.

Figure 5:
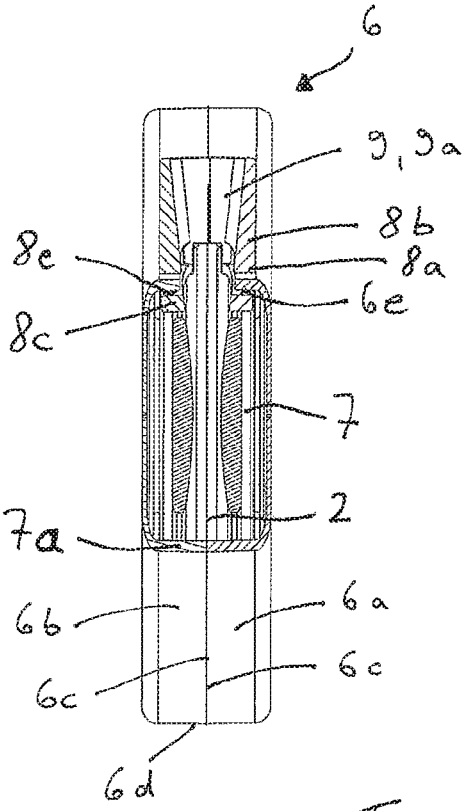
FIG. 5 shows a view shown in FIG. 4 partially in cross-section.

FIG. 5 shows the view shown in FIG. 4 but in a perpendicular sectional view so that the covering element 8 is sectioned in the region of its channel 9*a*. In relation to the channel 9*a*, it can be seen that, starting from the cable pulley 2, said channel widens upwards transverse to the circumferential direction of the covering hood 6. As a result, the load cable 3 can also be laterally deflected without excessive friction occurring between the load cable 3 and the inner wall of the channel 9*a*. In contrast, as can be seen in FIGS. 2 and 3, the channel 9*a* scarcely widens in the circumferential direction because in this case a cable deflection is compensated for by the displacement of the covering element 8 in the inlet and outlet opening 7.

Furthermore, FIG. 5 shows that the covering element 8 covers the edges of the inlet and outlet opening 7 externally with its main strip 8*a* which is formed on the upper end as a triangular guide region 8*b*. In the region of the guide region 8*b*, the main strip 8*a* is connected via its web strip 8*d* to the retaining strip 8*c* which engages behind the edges 6*c* of the inlet and outlet openings 7 (see FIG. 6). Accordingly, the retaining strip 8*c* is fastened to the lower side of the main strip 8*a* by means of the central web strip 8*d* so that the covering element 8 has an H-shaped cross-section in this region. As a result, the covering element 8 is displaceable on the covering hood 6 in the circumferential direction thereof. The retaining strip 8*c* thus lies with its guide surface 8*e*, facing the edge 6*c*, against the inner surface 6*e* of the edge 6*c*. There is no web strip 8*d* in the region of the opening 9 and the retaining strip 8*c* is retained in front of and behind the opening 9 by means of the web strip 8*d*. It can be seen in FIG. 2 that the retaining strip 8*c* extends over a region of approximately 30°. The part of the main strip 8*a* adjoining the guide region 8*d* at the bottom is not provided with a retaining strip 8*c* and a web strip 8*d*. Guidance is effected by means of the remainder of the covering element 8 with its retaining strip 8*c* in the region of the guide region 8*d*.

Figure 6:
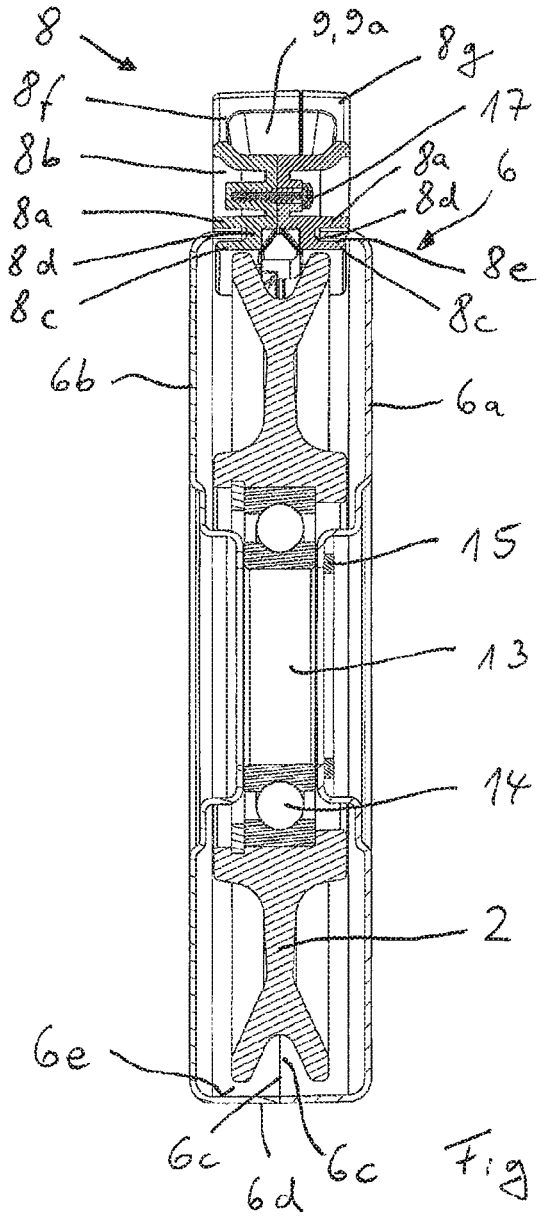
FIG. 6 shows a sectional view of FIG. 4.

FIG. 6 illustrates a further sectional view of FIG. 4, wherein the section is taken through the axle 13 of the cable pulley 2. The axle 13 is a component of the connecting element 4. The cable pulley 2 is mounted on the axle 13 by means of a bearing 14. The axle 13 or the connecting element 4 serves to support the circular inner and outer hood parts 6*a*, 6*b* which are formed as sheet metal formed parts. The inner hood part 6*b* which is slid firstly onto the axle is supported on a shoulder of the connecting element 4 which delimits the axle 13, followed by the bearing 14 and then the outer hood part 6*a* which is retained on the axle 13 by a locking ring 15. Moreover, the annular outer hood part 6*a* is closed in the region of the axle 13 by means of a circular cover 19. It can also be seen that the main strip 8*a* is strip-like in cross-section.

Figure 7:
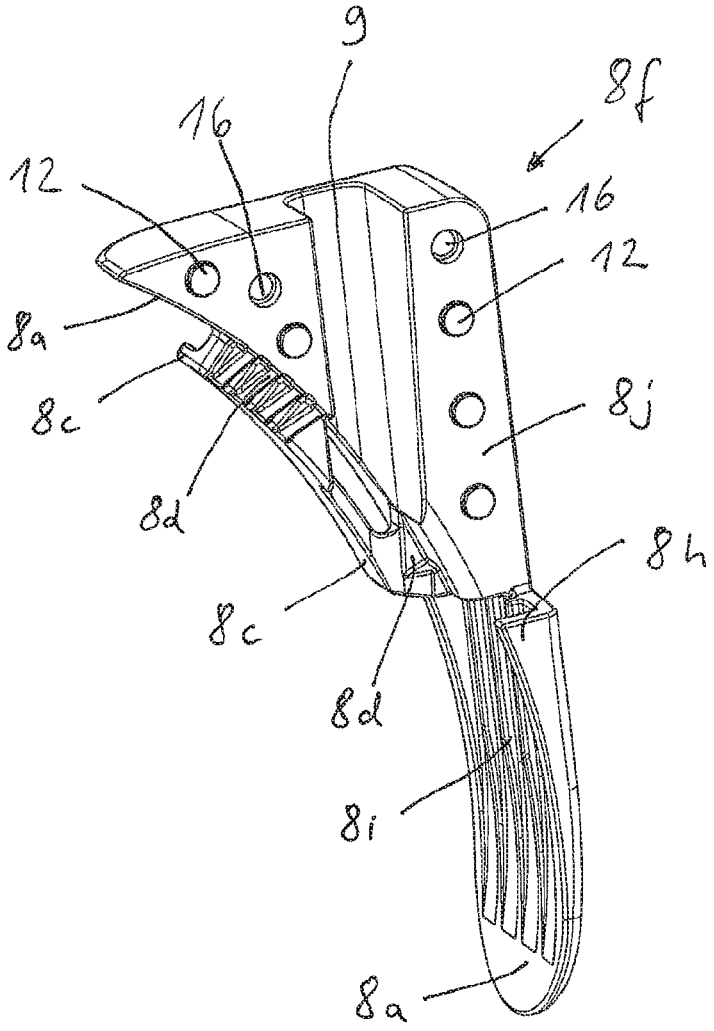
FIG. 7 shows a perspective view of a first covering part of the covering element.

FIG. 7 illustrates a perspective view of a first covering part 8*f* of the covering element 8 outside a lower block 1 and therefore in a non-mounted state. As previously described, the first covering part 8*f* consists substantially of a circular arc-shaped main strip 8*a* which, in the installation state, lies on the outer surface 6*d* of the covering hood 6. As seen approximately from the centre of the covering element 8, the upper part of the main strip 8*a* is widened to form a triangular guide region 8*b* or transitions into this guide region. The lower part of the main strip 8*a* remains strip-like and begins, as seen in the circumferential direction of the covering element 8, to be u-shaped in cross-section in the middle, wherein edge strips 8*h* laterally adjoin the edges of the main strip 8*a*. These edge strips 8*h* decrease in the direction of the lower end of the main strip 8*a* and are no longer present at the end of the main strip 8*a*. In addition, reinforcing ribs 8*i* for the main strip 8*a* which extend in parallel with one another and at a spaced interval from one another are provided on the inner side of the main strip 8*a* in order to ensure that the inlet and outlet opening 7 is securely covered and to save material. The width of the reinforcing ribs 8*i* decreases in the direction of the lower end of the main strip 8*a* in the same manner as the width of the edge strips 8*h*.

Figure 9A:
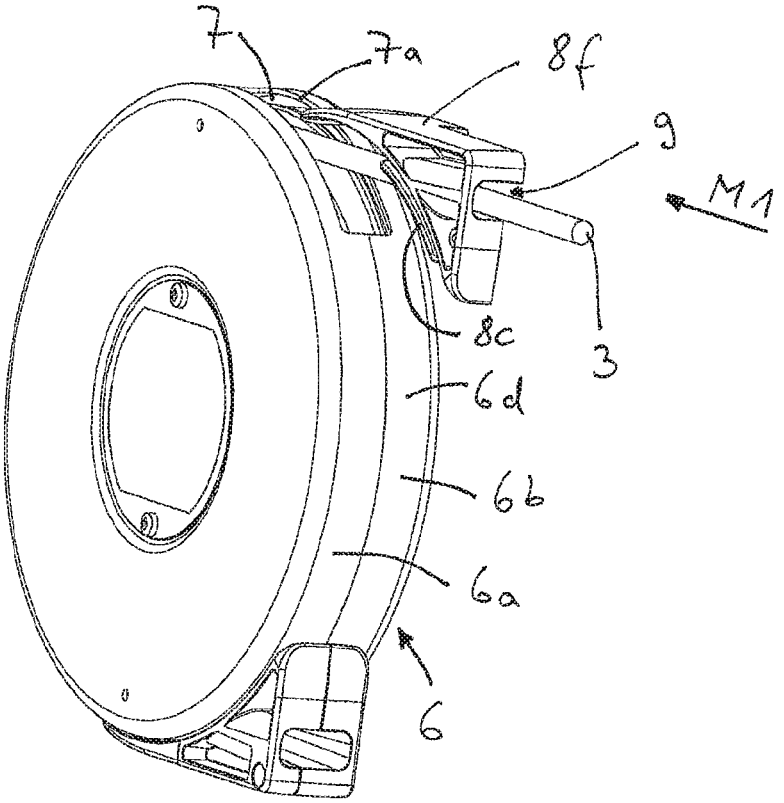
FIGS. 9*a* to 9*d* show a sequence of perspective views of the first and second covering parts of the covering element to illustrate the mounting on the covering hood of the lower block.
Figure 9B:
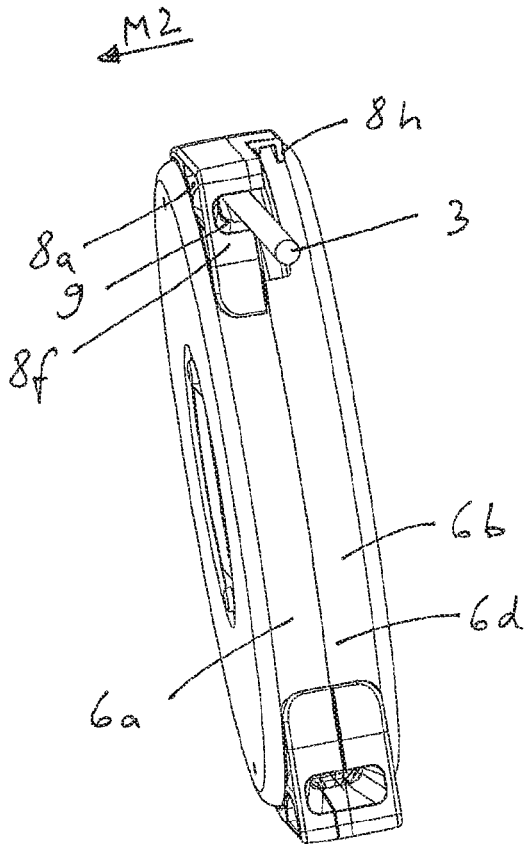
Figure 9C:
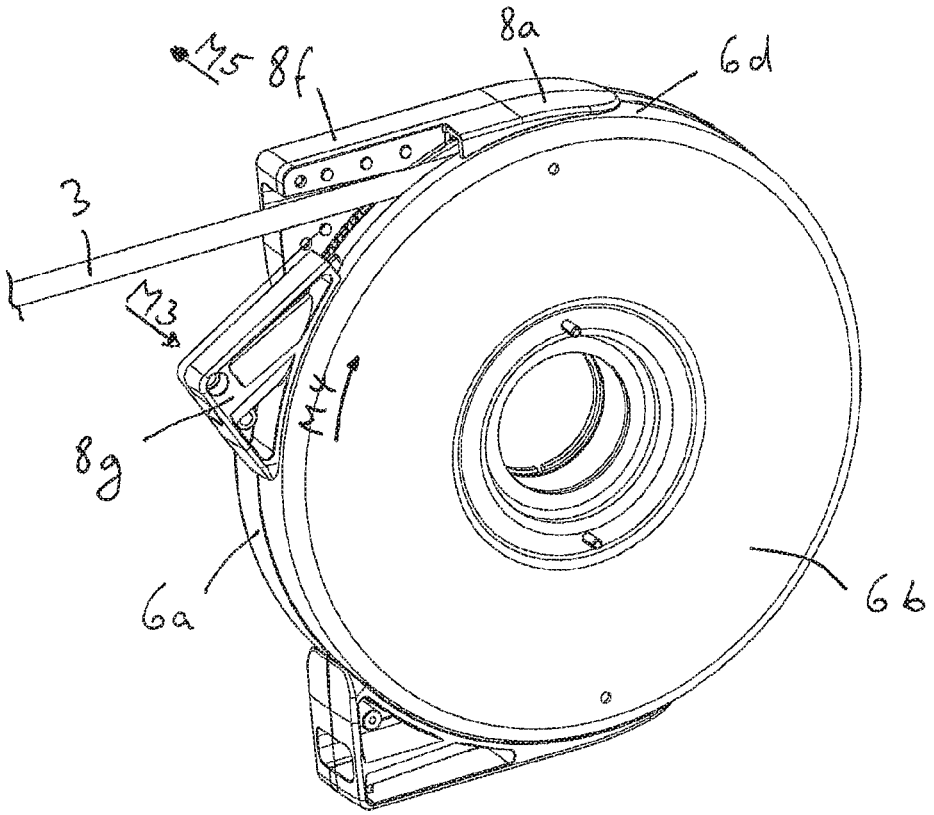
Figure 9D:
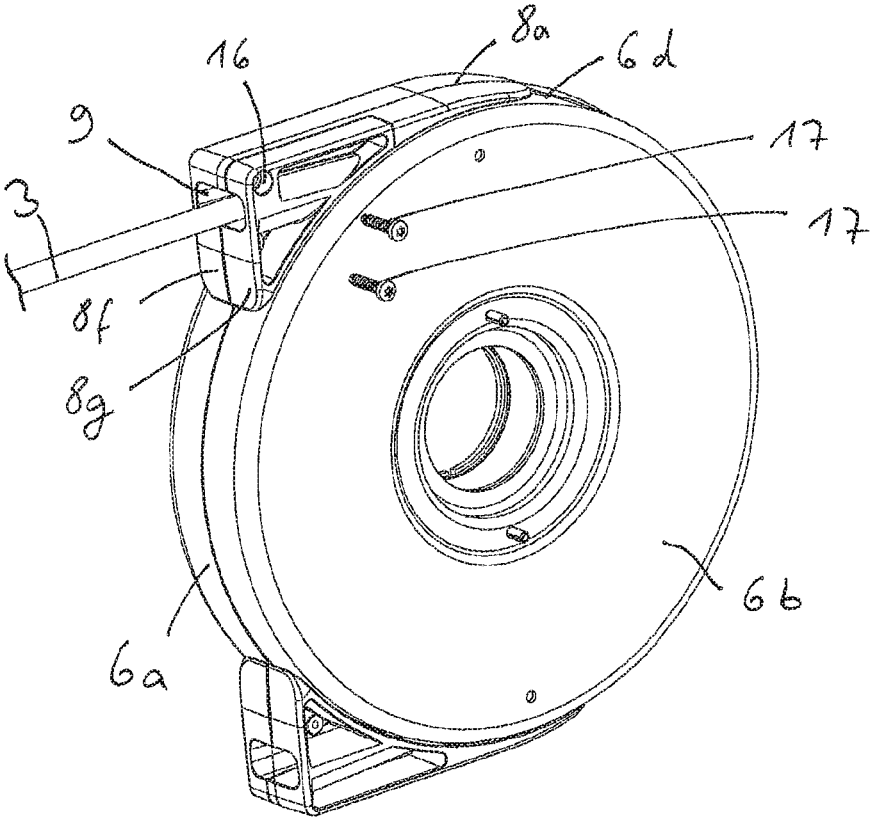

In the guide region 8*b* it is possible to see the opening 9 for the load cable 3. Flat cylindrical nubs 12 are arranged grid-like in the region of the first separating surface 8*j* of the first covering part 8*f* and each protrude from the first separating surface 8*j*. A cylindrical bore 16 for a screw 17 (see FIG. 9*d*) is also provided in the guide region 8*b* in each case on the right and left next to the opening 9. The bore 16 extends with its longitudinal extension in parallel with the axis of rotation of the cable pulley 2.

In addition, FIG. 7 shows that at the bottom the web strip 8*d* together with the retaining strip 8*c* adjoin the main strip 8*a* in the region adjacent to the opening 9 and extending in the circumferential direction of the covering hood 6. In the region of the opening 9, the web strip 8*d* is interrupted, the retaining strip 9*c* is continuous. It is evident that the retaining strip 8*c* is only approximately ⅓ of the length of the covering element 8 and therefore the covering element 8 can be guided and displaced in the circumferential direction of the covering hood 6.

Since the second covering part 8*g* is not placed onto the first separating surface 8*j*, the opening 9 is not tubular but instead is open in a groove-like manner.

Figure 8:
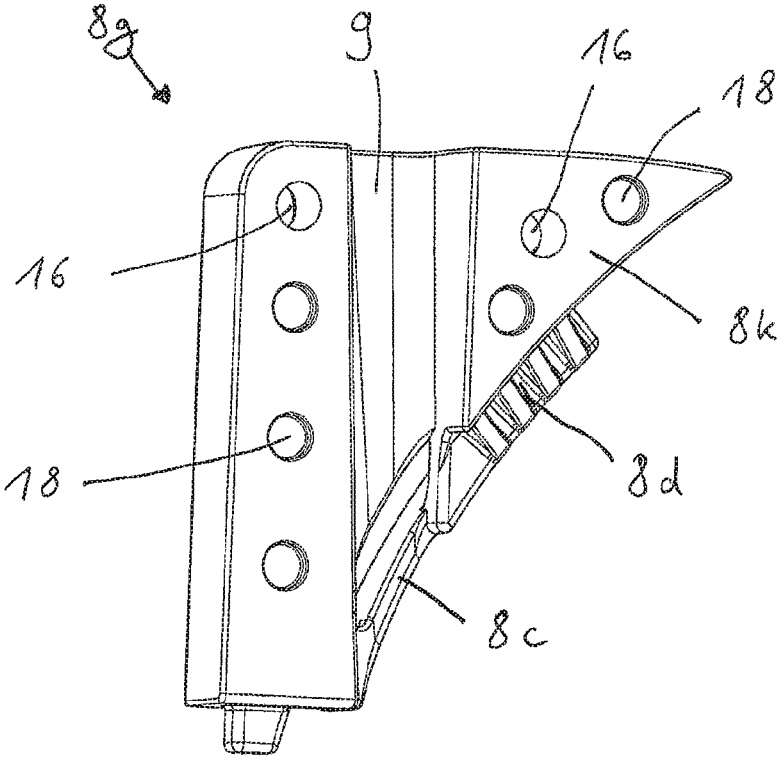
FIG. 8 shows a perspective view of a second covering part of the covering element.

FIG. 8 shows a perspective view of a second covering part 8*g* of the covering element 8 which is provided to complete the first covering part 8*f* after corresponding mounting to form the covering element 8 with a tubular opening 9. In relation to the first covering part 8*f* in FIG. 7, the second covering part 8*g* is illustrated in a mirror-inverted manner in order also to gain a view of a second separating surface 8*k*. In the mounted installation state, the first separating surface 8*j* of the first covering part 8*f* and the second separating surface 8*k* of the second covering part 8*g* lie one on top of the other. In order to facilitate their orientation with respect to one another and to improve their contact with one another, cylindrical apertures 18 arranged in a grid-like manner are arranged in the second separating surface 8*k* and, when the two covering parts 8*f*, 8*g* are in the mounted installation state, receive the nubs 12 of the first separating surface 8*j* in a form-fitting manner. The apertures 18, when engaged with the nubs 12, also absorb transverse forces and thus relieve the screws 17. Also, as in the case of the first covering part 8*f*, a bore 16 for the screw 17 is arranged in each case on the right and left next to the opening 9. In terms of shape, the second covering part 8*g* is comparable to the guide region 8*b*, i.e. is substantially triangular. As on the first covering part 8*j*, a retaining strip 8*c* is also arranged in the region of the main strip 8*a* of the second covering part 8*g* by means of a web strip 8*d*. The web strip 8*d* and the retaining strip 8*c* are adjacent to the opening 9 and, starting therefrom, extend only over a part of the main strip 8*a* of the second covering part 8*g*. In the region of the opening 9, the web strip 8*d* is interrupted. In the region of the web strip 8*d* and the retaining strip 8*c*, the first covering part 8*f* and the second covering part 8*g* are formed such that, in the mounted installation state, the respective parts of the web strip 8*d* and the retaining strip 8*c* of the first covering part 8*f* and of the second covering part 8*g* are combined to form a complete retaining strip 8*c* and a complete web strip 8*d* which then engage behind the right and left edge 7*a* of the inlet and outlet opening 7.

FIGS. 9*a* to 9*d* show a sequence of perspective views of a first covering part 8*f* and a second covering part 8*g* of a covering element 8 in order to explain in greater detail the individual necessary steps for mounting the covering element 8 on the covering hood 6 of a lower block 1. In a first mounting step, the first covering part 8*f* is slid with its opening 9 onto the region of the load cable 3 which comes out of the inlet and outlet opening 7 to be closed (see FIG. 9*a*). A spaced interval is provided between the covering part 8*f* and the inlet and outlet opening 7. Then, in a second mounting step, the first covering part 8*f* is pushed along the load cable 3 in the direction of the inlet and outlet opening 7 until the main strip 8*a* comes to lie externally on the outer surface 6*d* of the covering hood 6. Since the inlet and outlet opening 7 is wider than the part of the retaining strip 8*c* located on the first covering part 8*f*, the retaining strip 8*c*, when being slid on, can slide past the edge 7 of the inlet and outlet opening 7 into the interior of the covering hood 6. Then, in a third mounting step, the first covering part 8*f* resting on the outer surface 6*d* of the covering hood 6 is pushed laterally to the left in a mounting direction M2 which extends in parallel with the axle 13 of the cable pulley 2 (see FIG. 9*b*). As a result, the left part of the retaining strip 8*c* engages behind the left edge 7*a* of the inlet and outlet opening 7 and is thus retained in the inlet and outlet opening 7 in the radial direction of the cable pulley 2. In this case, the first covering part 8*f* is also displaced in the direction of the lower end of the inlet and outlet opening 7 so that an upper part of the inlet and outlet opening 7 is free. Then, in a fourth mounting step, the second covering part 8*g* is inserted into this free upper part of the inlet and outlet opening 7 until the main strip 8*a* comes to lie externally on the outer surface 6*d* of the covering hood 6 (see FIG. 9*c*). Since the inlet and outlet opening 7 is wider than the right part of the retaining strip 8*c* located on the second covering part 8*g*, the retaining strip 8*c*, when being slid on, can slide past the edge 7 of the inlet and outlet opening 7 into the interior of the covering hood 6. Then, in a fifth mounting step, the second covering part 8*f* resting on the outer surface 6*d* of the covering hood 6 is pushed laterally to the right in a mounting direction M3 which extends in parallel with the axle 13 of the cable pulley 2. As a result, the right part of the retaining strip 8*c* engages behind the right edge 7*a* of the inlet and outlet opening 7. This is then followed by a sixth mounting step in which the second covering part 8*g* is pushed along the outer surface 6*d* of the covering hood 6 in a mounting direction M4 onto the guide region 8*b* of the first covering part 8*f* until the front end of the second covering part 8*g* moves into abutment against the first covering part 8*f*. In this case, the right part of the retaining strip 8*c* still engages behind the right edge 7*a* of the inlet and outlet opening 7. In a seventh mounting step, the right and left covering part 8*f*, 8*g* are slid one onto the other in mounting direction M5 which extends in parallel with the axle of the cable pulley 2 so that the first and second separating surfaces 8*j*, 8*k* move into abutment and the nubs 12 each slide into the apertures 18 (see FIG. 9*d*). The height of the nubs 12 is selected—approximately 0.5 mm to 3.0 mm—such that after the two covering parts 8*f*, 8*g* have been slid one onto the other, the right and also the left retaining strip 8*c* securely engage behind the edge 7*a* of the inlet and outlet opening 7 and the covering element 8 is retained in the inlet and outlet opening 7 with a small amount of lateral clearance which corresponds at least to the height of the nubs 12. Subsequently, screws 17 are inserted into the bores 16 and the second covering part 8*g* is screwed to the first covering part 8*f*.

The invention claimed is:

1. A pulley block for hoists, having at least one cable pulley which is surrounded by a covering hood having inlet and outlet openings for a load cable, wherein a covering element is inserted into at least one of the inlet and outlet openings and is retained in the inlet and outlet opening by a retaining strip of the covering element which engages behind an edge of the inlet and outlet opening, the covering element has an opening for the load cable and the opening in the covering element is smaller than the inlet and outlet opening in the covering hood, wherein the covering element is divided at least into a first covering part and a second covering part that each include a part of the retaining strip in such a way that, in order to mount the covering element on the covering hood, while the load cable is in a reeved state, the first covering part and the second covering part can be inserted with their respective part of the retaining strip into the inlet and outlet opening, then engage behind the edge of the inlet and outlet opening and finally can be joined in order to form the covering element in a mounted installation state.

2. The pulley block as claimed in claim 1, wherein the edge comprises a pair of lateral edges and, as seen in the circumferential direction of the cable pulley, the part of the retaining strip on the first covering part is allocated for one of the lateral edges and the part of the retaining strip on the second covering part is allocated for the other lateral edge.

3. The pulley block as claimed in claim 1, wherein the first covering part and the second covering part are releasably connected to one another in the mounted installation state.

4. The pulley block as claimed in claim 1, wherein the covering element is divided into the first covering part and the second covering part in a plane which is oriented in the radial direction of the cable pulley and extends in the region of the opening of the covering element.

5. The pulley block as claimed in claim 1, wherein the inlet and outlet opening is slot-shaped and the covering element is displaceable in the inlet and outlet opening in the circumferential direction of the cable pulley.

6. The pulley block as claimed in claim 1, wherein the covering element covers the inlet and outlet opening from the outside and engages inwardly around the edges of the inlet and outlet opening with the retaining strip.

7. The pulley block as claimed in claim 1, wherein the covering element comprises a main strip, a web strip and the retaining strip which have an H-shaped cross-section, and the retaining strip lies with its guide surface against an inner surface of the covering hood in the region of the inlet and outlet opening.

8. The pulley block as claimed in claim 1, wherein the covering element is widened at one end in the shape of a triangle to form a guide region which accommodates the opening for the load cable, said opening being formed as a channel.

9. The pulley block as claimed in claim 8, wherein the covering element in the guide region is divided into the first covering part and the second covering part and the retaining strip in the guide region is arranged on the covering element.

10. The pulley block as claimed in claim 1, wherein the pulley block comprises a lower block.

11. The pulley block as claimed in claim 10, wherein the edge comprises a pair of lateral edges and, as seen in the circumferential direction of the cable pulley, the part of the retaining strip on the first covering part is allocated for one of the lateral edges and the part of the retaining strip on the second covering part is allocated for the other lateral edge.

12. The pulley block as claimed in claim 11, wherein the first covering part and the second covering part are releasably connected to one another in the mounted installation state.

13. The pulley block as claimed in claim 12, wherein the covering element is divided into the first covering part and the second covering part in a plane which is oriented in the radial direction of the cable pulley and extends in the region of the opening of the covering element.

14. The pulley block as claimed in claim 13, wherein the inlet and outlet opening is slot-shaped and the covering element is displaceable in the inlet and outlet opening in the circumferential direction of the cable pulley.

15. The pulley block as claimed in claim 14, wherein the covering element covers the inlet and outlet opening from the outside and engages inwardly around the edges of the inlet and outlet opening with the retaining strip.

16. The pulley block as claimed in claim 15, wherein the covering element comprises a main strip, a web strip and the retaining strip which have an H-shaped cross-section, and the retaining strip lies with its guide surface against an inner surface of the covering hood in the region of the inlet and outlet opening.

17. The pulley block as claimed in claim 16, wherein the covering element is widened at one end in the shape of a triangle to form a guide region which accommodates the opening for the load cable, said opening being formed as a channel.

18. The pulley block as claimed in claim 17, wherein the covering element in the guide region is divided into the first covering part and the second covering part and the retaining strip in the guide region is arranged on the covering element.

19. A method for mounting the covering element on the pulley block of claim 1, comprising:

introducing the first covering part with its part of the retaining strip into the inlet and outlet opening along the load cable;

displacing the first covering part in the axial direction of the cable pulley so that the part of the retaining strip of the first covering part engages behind an allocated portion of the edge of the inlet and outlet opening;

introducing the second covering part with its part of the retaining strip into a part of the inlet and outlet opening not occupied by the first covering part;

displacing the second covering part in the axial direction of the cable pulley so that the part of the retaining strip of the second covering part engages behind another allocated portion of the edge of the inlet and outlet opening that is opposite the allocated portion of the edge for the part of the retaining strip of the first covering part;

displacing the second covering part in the inlet and outlet opening in the circumferential direction of the cable pulley in the direction of the first covering part to form the opening for the load cable;

pushing the first covering part and the second covering part in the axial direction of the cable pulley towards one another; and releasably connecting the first covering part and the second covering part together.

* * * * *